US006189511B1

(12) United States Patent
Dzierzawski et al.

(10) Patent No.: US 6,189,511 B1
(45) Date of Patent: Feb. 20, 2001

(54) CLIP-ON DEFLECTOR FOR A FUEL INJECTOR

(75) Inventors: Radoslawk Dzierzawski, Prairie View; David S. Esbrook, Bartlett, both of IL (US)

(73) Assignee: Navistar International Transporation Corp, Chicago, IL (US)

( * ) Notice: Under 35 U.S.C. 154(b), the term of this patent shall be extended for 0 days.

(21) Appl. No.: 09/392,373

(22) Filed: Sep. 7, 1999

(51) Int. Cl.[7] ..... F02B 77/00
(52) U.S. Cl. ..... 123/472; 123/198 R; 439/271
(58) Field of Search ..... 123/196 R, 198 R, 123/446, 472; 239/88–92; 439/130, 271

(56) References Cited

U.S. PATENT DOCUMENTS

| | | | |
|---|---|---|---|
| 4,950,171 | 8/1990 | Muzslay | 439/76 |
| 4,953,801 | 9/1990 | Polawa | 248/65 |
| 4,974,798 | 12/1990 | Harding et al. | 248/73 |
| 5,060,625 | 10/1991 | Bruning | 123/647 |
| 5,142,744 | 9/1992 | Bruning | 123/16 R |
| 5,238,415 | 8/1993 | Bittner et al. | 439/130 |
| 5,607,315 | 3/1997 | Bonnah II, et al. | 439/130 |
| 5,642,704 | 7/1998 | Gogots et al. | 123/198 R |
| 5,828,009 | 10/1998 | James et al. | 174/135 |

*Primary Examiner*—Tony M. Argenbright
(74) *Attorney, Agent, or Firm*—Jeffrey P. Calfa; Dennis KellySullivan; Gilberto Hernandez

(57) ABSTRACT

The present invention describes a deflector clip (200) for a fuel injector (100) in an internal combustion engine. The deflector clip (200) has a clip portion (205) and a deflector portion (210). The clip portion (205) has a fixed arm (270) and an adjustable arm (265), which form a slot (275) for mounting the deflector clip (200) onto the fuel injector. The deflector portion (205) deflects the hydraulic fluid draining from the fuel injector. The deflector clip (200) is design to fit any fuel injector having a tolerance within the minimum and maximum tolerances for a fuel injector. In an alternate embodiment, several deflector clips (200) are arranged in a deflector clip assembly (400, 500) having a wiring harness (402, 502) for the fuel injection system.

25 Claims, 7 Drawing Sheets

200
205
245
260
270
282
242
240
242
275
265
255
235
250
230
210
215
220
232
225
227
295

265
275
295
310
330
255
250
320

240
235
340
360
232
230
220
350
215

240
285
340
235
290
230

260
240
255
235
230
340
220
225
270
282
265
280
350
232
360
227

240
255
250
290
230
282
280
340

270
275
265
255
250
280
340
225
350
282
295
235
230
215
220

265
330
255
250
280
275
225
295
230

215
340
350
295
230
225
250
220

FIG. 16
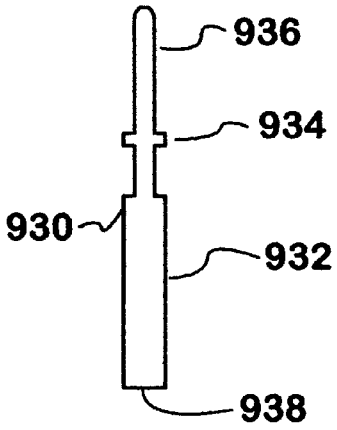
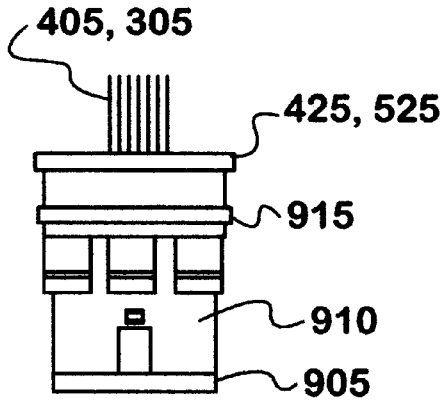
FIG. 14
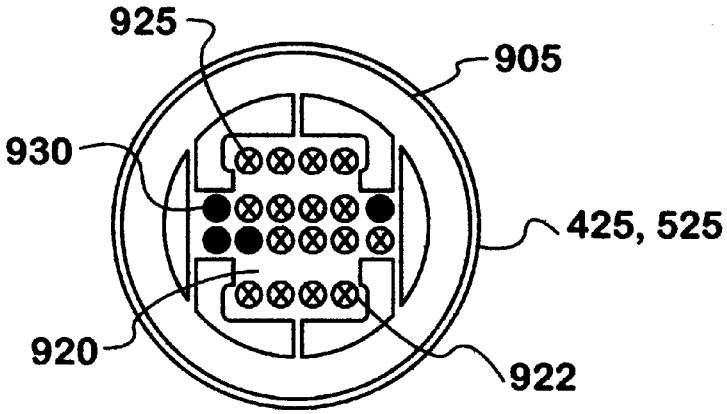
FIG. 15

FIG. 18
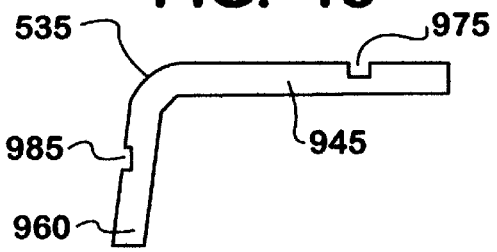
FIG. 20
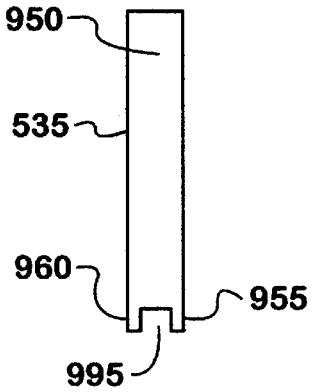
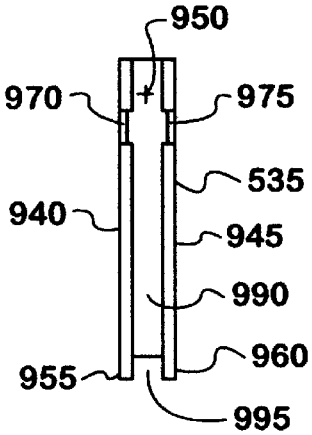
FIG. 19
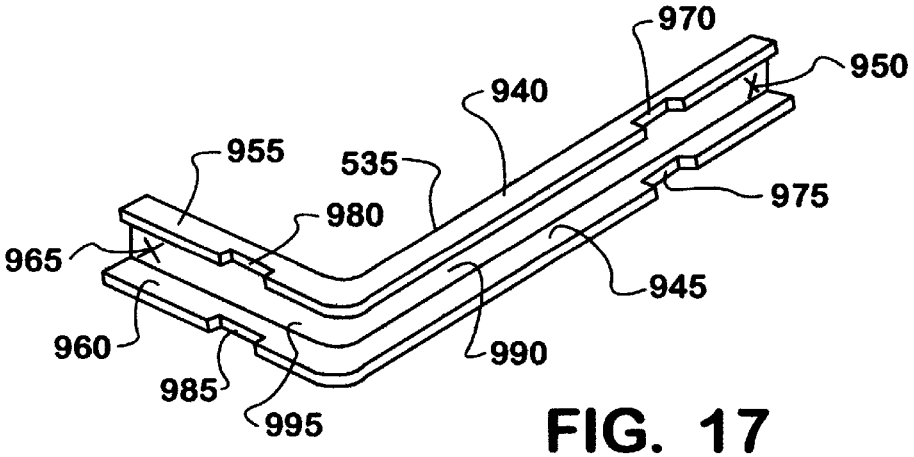
FIG. 17

CLIP-ON DEFLECTOR FOR A FUEL INJECTOR

FIELD OF THE INVENTION

This invention relates generally to fuel injection systems for internal combustion engines. More particularly, this invention relates to deflectors for fuel injectors in a diesel engine.

BACKGROUND OF THE INVENTION

Many diesel engines have hydraulically activated and electronically controlled fuel injection systems. In these systems, a microprocessor sends a control signal to trigger electric current pulses to the fuel injectors. At the start of an injection cycle, the electric current pulse energizes a solenoid to operate a valve in the fuel injector. The valve opens an hydraulic conduit letting high-pressure hydraulic fluid operate an intensifier piston. Operation of the intensifier piston causes the injector to inject fuel into the cylinder.

At the end of the injection cycle, the microprocessor stops the electric current pulse. As the solenoid de-energizes, the valve returns to its position at the start of the cycle. This action enables the valve to open the drain on the fuel injector, thus draining hydraulic fluid out of the injector. The loss of hydraulic fluid enables the intensifier piston to return to its position at the start of the cycle.

When hydraulic fluid is released by the fuel injector, the fluid drains out of a drain on the side of the injector. The "spring back" of the intensifier piston causes hydraulic fluid to spray or spurt out of the drain. If not deflected upon its exit from the injector, the hydraulic fluid will turn into a mist. The misted hydraulic fluid will mix with air and vent outside the engine.

To prevent misting of hydraulic fluid from the fuel injector, deflectors are mounted on or near the fuel injectors. Some designs bolt a deflector onto the injector or other part of the engine. Other designs provide a series of connected deflectors or a deflector rail similarly bolted to the fuel injectors or engine. Both designs take excessive space, increase the weight of the engine, and are costly to make and install. Also, none of these designs attaches to or supports an electrical wiring harness for fuel injectors.

Generally, wires for transmitting electrical pulses to the fuel injectors are grouped to form a single wiring harness. When installed, the harness lays atop and aside the injectors underneath the valve cover. In these positions, the wires may be damaged or otherwise may not work properly for the life of the engine. The harness connects the wires through the engine's valve cover to an electric pulse generator and microprocessor outside the engine.

Accordingly, there is a need for a hydraulic deflector with a smaller size and with the capability to support the wiring harness away from the fuel injectors in an internal combustion engine.

SUMMARY OF THE INVENTION

The present invention provides deflector clip having a clip portion and a deflector portion. The clip portion has a clip body forming a fixed arm and an adjustable arm. The clip body and arms define a slot for mounting the deflector clip on a fuel injector. The clip portion also has a back brace integrally joined to the clip body. The back brace couples with a top support, which is axially connected to the fixed arm. The back brace also couples with a bottom support, which is essentially parallel to the adjustable arm. The bottom support and the adjustable arm separate to form an adjustment aperture.

The deflector portion has a deflector cavity defined by a flat side, tapered side, top and nose. The back and bottom remain open. When the deflector clip is mounted on a fuel injector, the deflector portion is disposed adjacent to the drain of the fuel injector. In this position, the deflector portion deflects hydraulic fluid draining from the fuel injector into a designated place in the engine.

The deflector portion attaches to the clip portion via a bridge element. The bridge element has a full gusset and a half gusset to strengthen and stabilize the connection.

The deflector clip is designed to fit any fuel injector having tolerances within the tolerance range for fuel injectors on the engine. When the adjustable arm is not flexed, the distance between the fixed arm and the adjustable is the minimum tolerance for the fuel injector. When the adjustable arm is fully flexed, the distance between the fixed arm and the adjustable arm is the maximum distance for the fuel injector. Accordingly, the deflector clip avoids problems from deflector clips not fitting some fuel injectors and deflector clips fitting some fuel injectors too loosely.

In another embodiment, several deflector clips are arranged in a deflector clip assembly having a wiring harness for the fuel injectors. The wiring harness may be a standard or compression brake wiring harness for the fuel injection system. Each deflector clip is attached using a tie band.

In addition, the electrical connector plug in each wiring harness may use a sealing plug pin to seal pin holes. The compression brake harness may have a bracket on compression brake wire extension to support and guide the wire around the fuel injector.

The following drawings and description set forth additional advantages and benefits of the invention. More advantages and benefits are obvious from the description and may be learned by practice of the invention.

BRIEF DESCRIPTION OF THE DRAWINGS

The present invention may be better understood when read in connection with the accompanying drawings, of which:

FIG. 14 is a side view of an electrical connector plug for the wiring harness in either FIG. 12 or FIG. 13 according to the present invention;

FIG. 15 is a top view of the electrical connector plug in FIG. 14 according to the present invention;

FIG. 16 is a side view of a sealing plug pin for the electrical connector plug in FIG. 14 according to the present invention;

FIG. 17 is a perspective view of an L-bracket for the compression brake wiring harness in FIG. 13 according to the present invention;

FIG. 18 is a side view of the L-bracket in FIG. 17 according to the present invention;

FIG. 19 is a top view of the L-bracket in FIG. 17 according to the present invention; and FIG. 20 is a bottom view of the L-bracket in FIG. 17 according to the present invention.

DETAILED DESCRIPTION OF THE INVENTION

Figure 1:
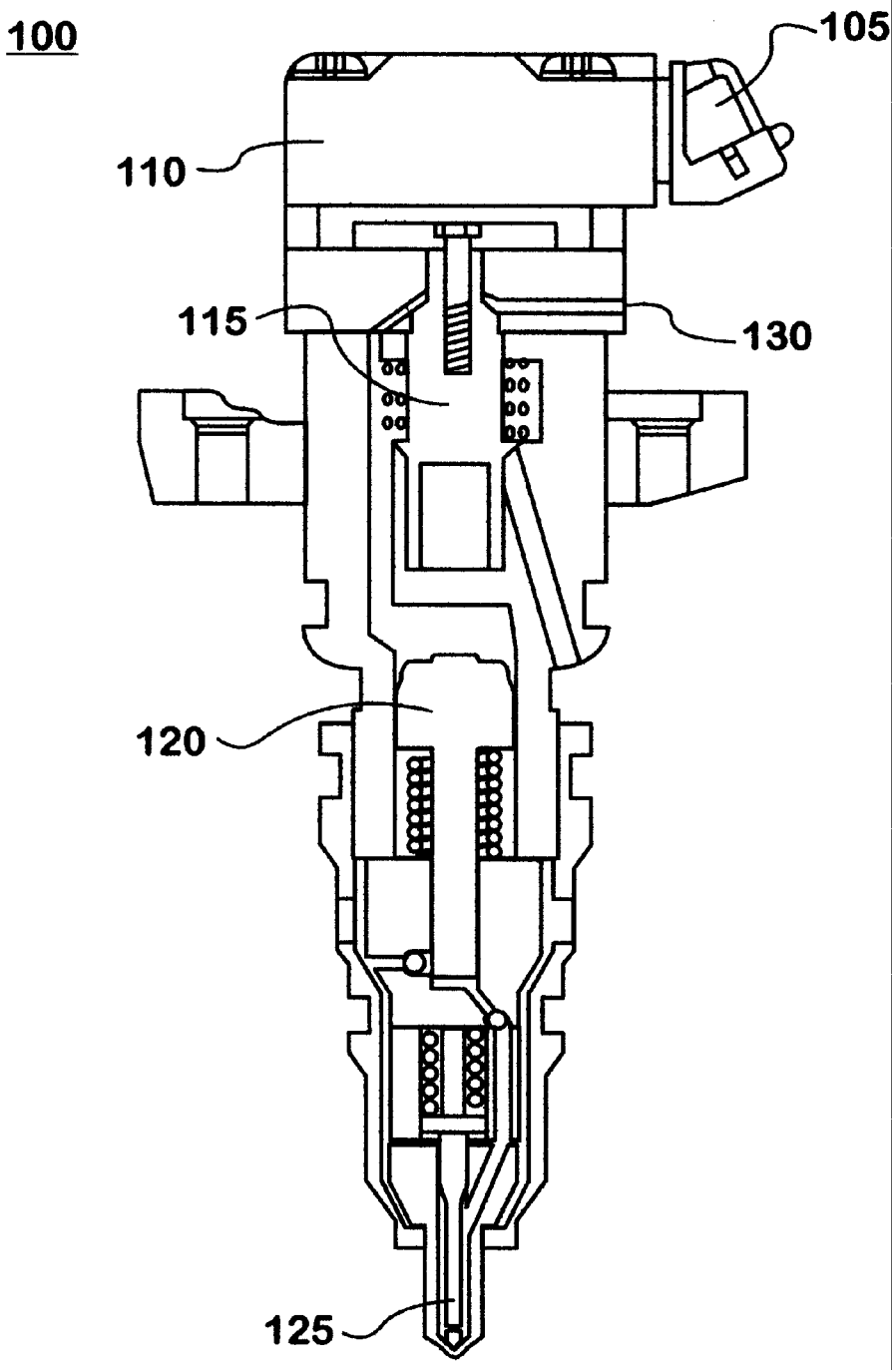
FIG. 1 PRIOR ART
FIG. 1 is a side view of a hydraulically actuated electrically controlled fuel injector according to the prior art.
Figures 2, 3, 4, 5, 6, 7, 8, 9, 10:
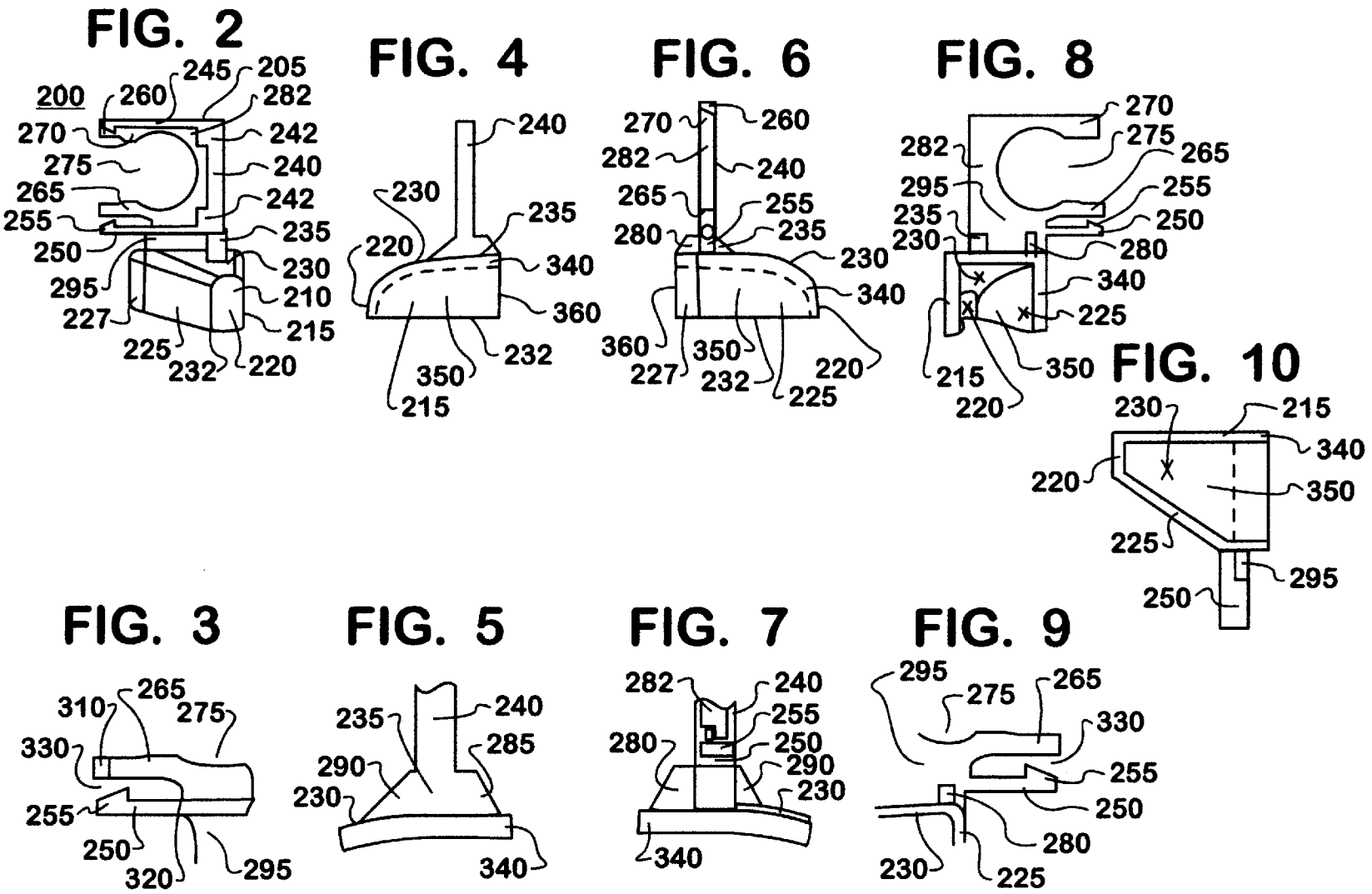
FIG. 2 is a front perspective view of a deflector clip for a fuel injector according to the present invention.
FIG. 3 is a close-up view of the adjustable arm and bottom support portions of the deflector in FIG. 2 according to the present invention.
FIG. 4 is a flat side view of the deflector in FIG. 2 according to the present invention.
FIG. 5 is a close-up view of the full gusset portion of the deflector in FIG. 4 according to the present invention.
FIG. 6 is a tapered side view of the deflector in FIG. 2 according to the present invention.
FIG. 7 is a close-up view of the half gusset portion of the deflector in FIG. 6 according to the present invention.
FIG. 8 is a rear perspective view of the deflector clip in FIG. 2 according to the present invention.
FIG. 9 is close-up view of the adjustable arm and bottom support portions of the deflector in FIG. 8 according to the present invention.
FIG. 10 is a bottom view of the deflector in FIG. 2 according to the present invention.

FIG. 1 shows a hydraulically activated electronically controlled fuel injector 100 according to the prior art. The fuel injector 100 is nearing the end of its fuel injection cycle. A microprocessor (not shown) stopped the electric current pulse sent to an solenoid interface 105 via a wire (not shown). Without the electric current pulse, the solenoid 110 has de-energized. The poppet valve 115 has returned to its pre-injection position, thus opening the drain 130. As hydraulic fluid drains from the fuel injector, the intensifier piston 120 will return to its pre-injection position. The nozzle valve 125 has closed, stopping the injection of fuel.

FIGS. 4–12 show various views of deflector clip 200, which has a clip portion 205 and a deflector portion 210 connected by a bridge element 295. The deflector clip 200 is made as a single part from plastic via injection molding. However, it may be made from other materials and processes, and as an assembly of parts.

The deflector portion 210 forms a deflector cavity 350 defined by a flat side 215, a nose piece 220, a tapered side 225, and a top 230. The bottom 232 and back 360 are open. The top 230 angles downward toward the nose piece 220. The tapered side 225 has a ledge 227 essentially parallel to the flat side 215. The remainder of the tapered side 225 angles toward the flat side 215 as it connects with the nose piece 220. The flat side 215, nose piece 220, tapered side 225, and top 230 form an essentially continuous wall 340 having substantially uniform thickness. Hydraulic fluid spraying, spurting, or otherwise draining out of the fuel injector is deflected along the inside contour of the deflector cavity 350. The deflector portion 210 may have different shapes as long as it deflects the hydraulic fluid properly.

The clip portion 205 has a clip body 282 with an adjustable arm 265 and a fixed arm 270. The clip body 282 and arms 265, 270 define a slot 275 for mating with the solenoid interface 105. The adjustable arm 265 and fixed arm 270 each have a beveled tip 310 to assist mating with the solenoid interface 105.

The clip body 282 has a back brace 240 formed substantially perpendicular to arms 265, 270. The back brace 240 extends to form a top support 245 and a bottom support 250 with a stabilizing square 242 at each connection. The top support 245 is connected axially to the fixed arm 270. The bottom support 250 is disposed parallel to and beneath the adjustable arm 265. Bottom support 250 and the adjustable arm 265 separate at intersection 320 to form an adjustment aperture 330. The top and bottom supports 245, 250 and the arms 265, 270 have essentially the same length.

The clip portion 205 is configured so deflector clip 200 may be mounted on any fuel injector having dimensions of its solenoid interface 105 within tolerance. The top and bottom supports 245, 250 are tapered to be closer at the opening to the slot 275. The top support 245 forms a top wedge 260 disposed to point toward the bottom support 250. The bottom support 250 forms a bottom wedge 255 disposed to point toward the adjustable arm 265 and the top support 245.

When the adjustable arm 265 is not flexed, the distance between the top wedge 260 and the adjustable arm 265 is slightly smaller than the minimum tolerance for the solenoid interface 105. When the adjustable arm 265 is fully flexed, the distance between the top wedge 260 and the adjustable arm 265 is equal to or slightly greater than the maximum tolerance for the solenoid interface 105. On installation, the adjustable arm 265 flexes slightly to snap the clip portion 205 onto the solenoid interface 105.

Deflector clip 200 is designed to fit any solenoid interface in a production run. With the adjustable arm 265 separated from the bottom support 250, the clip portion 205 adjusts to the varying dimensions for solenoid interfaces. In addition, the adjustable arm 265 permits these adjustments without distorting the position of the deflector portion 210 adjacent to the fuel injector. Once mounted on the fuel injector, the top wedge 260 and adjustable arm 265 hold the deflector clip 200 in place.

The capability to fit all fuel injectors in a production run is essential in modem manufacturing processes. Without this capability, some deflectors would not fit some fuel injectors. The problem worsens because it would not be known until the someone attempts to mount the deflector on the fuel injector. At that point, the "solution" is to scrap the deflector even though it may fit another fuel injector. Conversely, some deflectors may fit, but fit loosely. Here again, the problem would not be known until the deflector is mounted. To avoid these problems, the deflector clip 200 is designed to fit snuggly on fuel injectors from the minimum tolerance through the maximum tolerance for the fuel injector.

The bridge element 295 connects the clip portion 205 to the deflector portion 210. The bridge element 295 forms a full gusset 235 and half gusset 280 attached to the deflector portion 210 and substantially perpendicular to the clip portion 405. The full gusset 235 is disposed adjacent to the flat side 215. The half gusset 280 is disposed adjacent to the tapered side 225. Gussets 235, 280 are essentially triangular in shape to improve the stability of the connection between the clip portion 205 and the deflector portion 210. More, less, or even no gussets may be used. The gussets also may be smaller or larger. A single full and/or half gusset may be used, including one or more which extend the width of the deflector portion 210. In addition, clip portion 205 may attach directly to deflector portion 210 without the bridge element 295.

Figure 11:
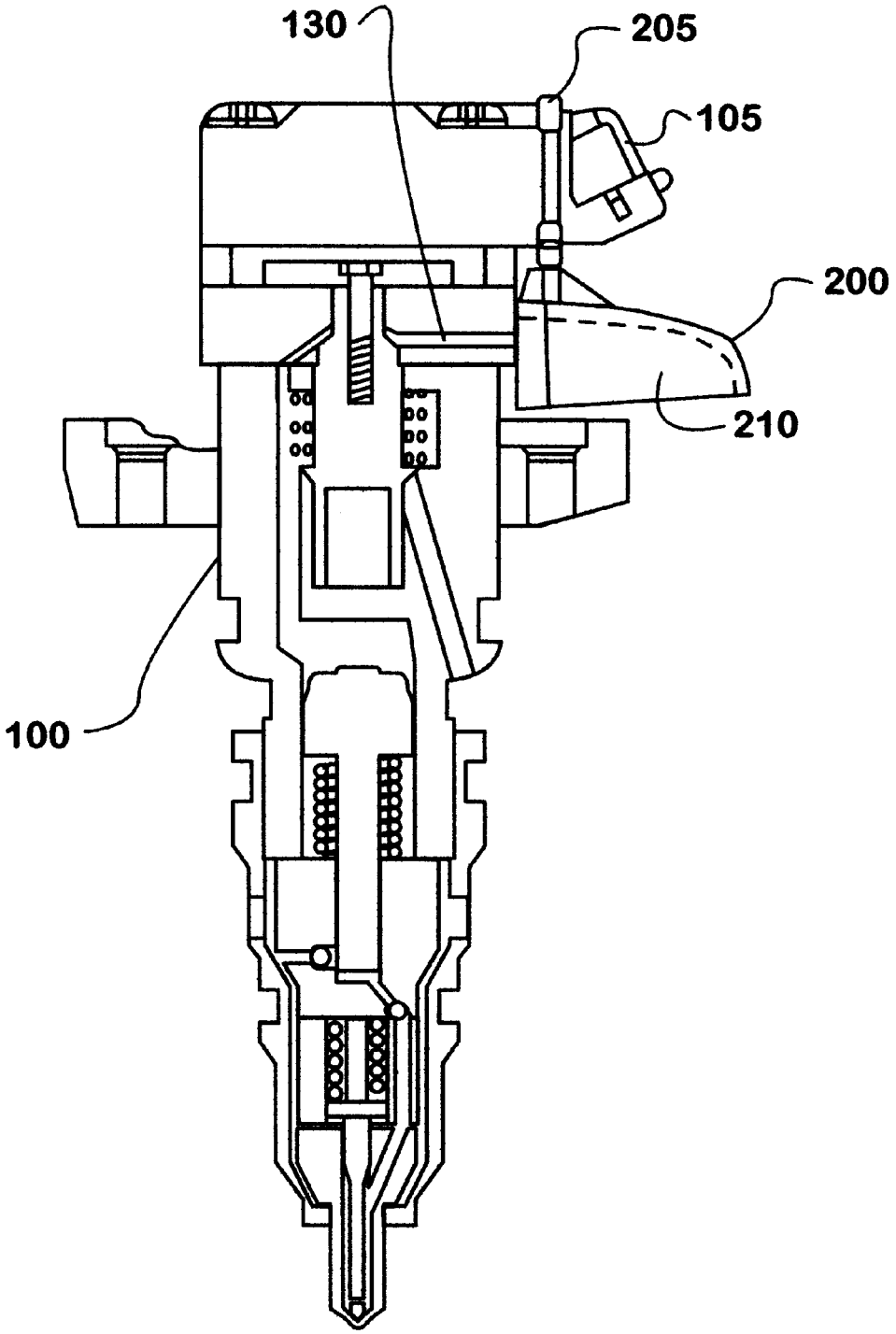
FIG. 11 is a side view of a fuel injector with the deflector clip mounted according to the present invention.

As shown in FIG. 11, the clip portion 205 is configured to mate with the solenoid interface 105 when mounted on injector 100. The deflector portion 210 is positioned adjacent to the drain 130 for deflecting hydraulic fluid. The flat side 215, ledge 227, and top 230 are essentially flush with the fuel injector. Hydraulic fluid from drain 130 is deflected by the deflector portion 210. The positioning of the deflector portion 210 and the inside contour of the deflector cavity 350 may be configured to deflect the hydraulic fluid to a particular location.

Figure 12:
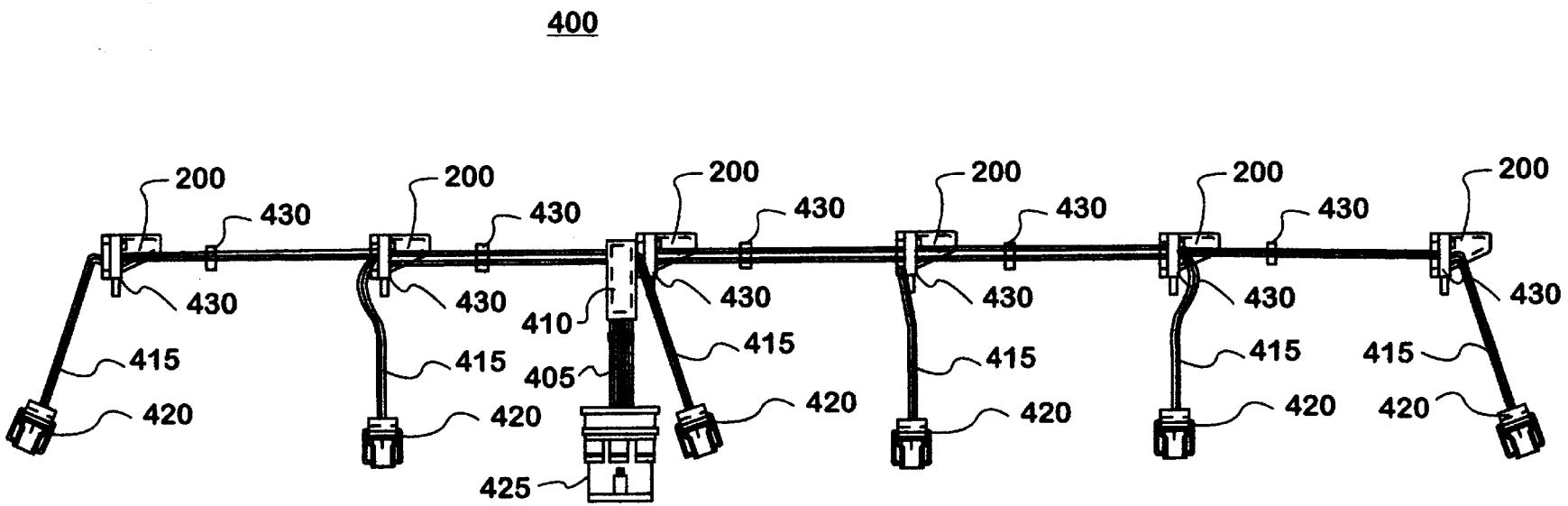
FIG. 12 is a top view of a deflector clip assembly having a standard wiring harness according to the present invention.

In another embodiment shown in FIG. 12, several deflector clips 200 are arranged in a deflector clip assembly 400 having a standard wiring harness 402 for the fuel injection system. The deflector clip assembly 400 supports and routes the wiring harness above and around the fuel injectors. Each deflector clip 200 is connected to the standard wiring harness 402 by a tie band 430. The top support 245 of each deflector clip 200 may form posts (not shown) for use with the tie band 430 to connect the deflector clips 200 to the standard wiring harness 402. Other methods may be used to connect the deflector clips 200 to the standard wiring harness 402 including a bracket formed by the posts (not shown).

The deflector clip assembly 400 is for the fuel injection system of an in-line, six-cylinder diesel engine. However, the deflector clip assembly 400 including the standard wiring harness 402 may be modified for any number of cylinders and V or other engine configurations.

The standard wiring harness 402 has several electrical wires 405 bundled together using tie bands 430. As shown, a T-junction clip 410 may be used to separate the electrical wires 405 into two sets. The electrical wires 405 are the kind used in internal combustion engines. Electrical wires 405 connect an electrical connector plug 425 to an injector connector 420 for each fuel injector. The electrical connector plug 425 provides a connection through the valve cover (not shown).

For each fuel injector, the standard wiring harness 402 has an injector wire extension 415 connected to an injector connector 420. Each injector wire extension 415 has a ground wire (not shown) and a hot lead (not shown). The injector connector 420 connects to the solenoid interface 105.

The ground wire for each fuel injector runs to the electrical connector plug 425. However, ground wires for two or more fuel injectors may be spliced together so the fuel injectors inject fuel at the same time. A common ground wire for the connected fuel injectors would run to the electrical connector plug 425.

For each fuel injector, a deflector clip 200 is attached to the electrical wires 405 of the wiring harness 402. The deflector clip is attached using a tie band 430. However, other attachment means may be used including a part formed by the clip portion 205. The deflector clip 200 is attached to the electrical wires 405 at a position where the injector wire extension 415 has sufficient length for the injector connector 420 to connect with the solenoid interface 105.

Figure 13:
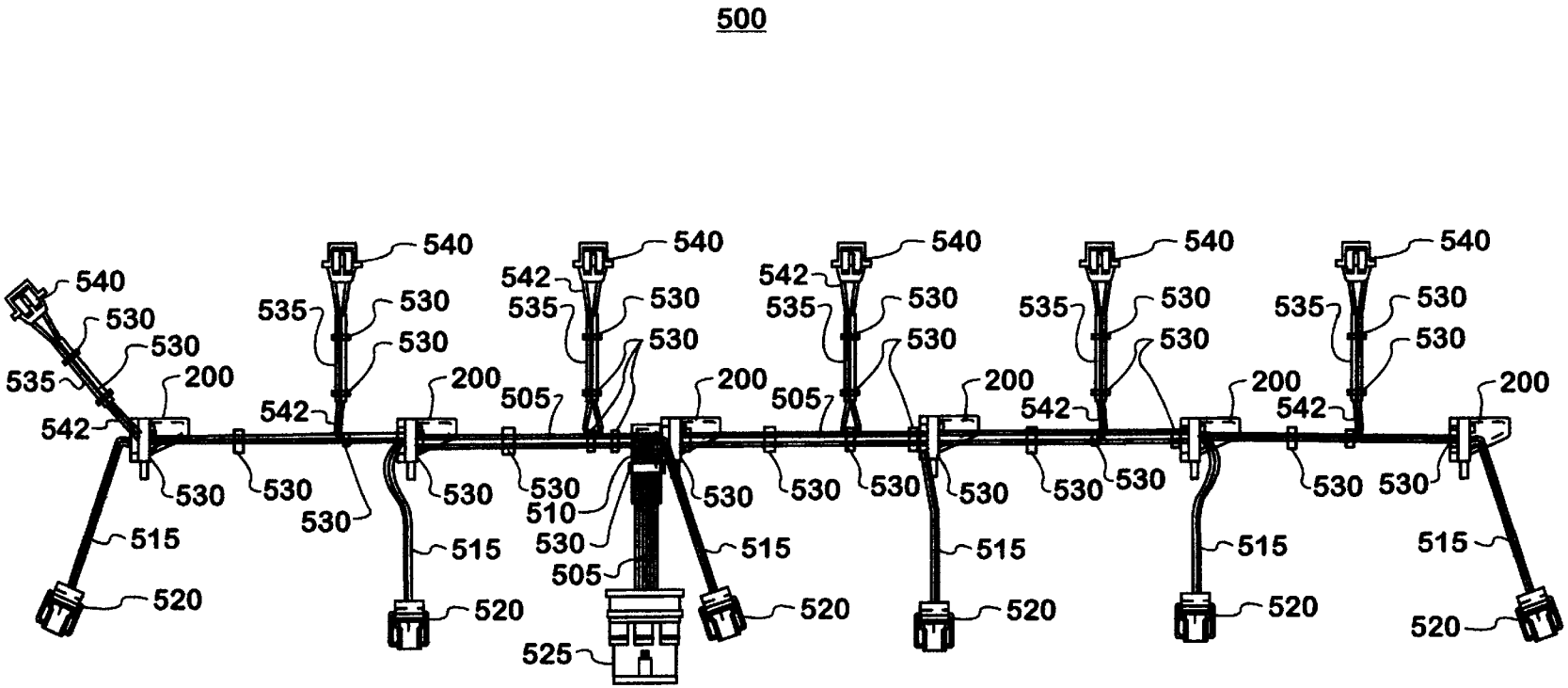
FIG. 13 is a top view a deflector clip assembly having a compression brake wiring harness according to the present invention.

FIG. 13 shows several deflector clips 200 arranged in a deflector clip assembly 500 having a compression brake wiring harness 502 for a fuel injection system according an alternate embodiment. As with the deflector clip assembly 400, the deflector clip assembly 500 is for an in-line, six-cylinder diesel engine. Likewise, it may be modified for any number of cylinders and V or other engine configurations.

The compression brake wiring harness 502 has several electrical wires 505 bundled together using tie bands 530. As shown, a T-junction clip 510 may be used to separate the electrical wires 505 into two sets. The electrical wires 505 are of the kind of wire used in internal combustion engines. The electrical wires 505 connect an electrical connector plug 525 to an injector connector 520 and a compression brake connector 540 for each fuel injector. The electrical connector plug 525 provides a connection through the valve cover (not shown).

For each fuel injector, the compression brake wiring harness 502 has an injector wire extension 515 connected to the injector connector 520. Each injector wire extension 515 has a first ground wire (not shown) and a first hot lead (not shown). Each injector connector 520 connects to a solenoid interface 105.

The first ground wire for each fuel injector runs to the electrical connector plug 525. However, first ground wires for two or more fuel injectors may be spliced together so the fuel injectors inject fuel at the same time. A common ground wire for the connected fuel injectors would run to electrical connector plug 525.

For each fuel injector, the compression brake wiring harness 502 also has a compression brake wire extension 542 connected to a compression brake connector 540. Each compression brake wire extension 542 has an L-bracket 535 for guiding the wires around the fuel injector. The compression brake wire extension 542 is attached to the L-bracket 535 using a pair of tie bands 530. Each compression brake wire extension 542 also has a second ground wire (not shown) and a second hot lead (not shown). The compression brake connector 540 connects to the compression brake interface.

The second ground wire for each fuel injector runs to the electrical connector plug 525. The second ground wires for all the fuel injectors may be spliced together so the fuel injectors "brake" the engine at the same time. Preferably, the ground wires for pairs of fuel injectors are spliced together to provide "staged" braking of the engine. A common ground wire would run to the electrical connector plug 525.

For each fuel injector, a deflector clip 200 is attached to the electrical wires 505 of the compression brake wiring harness. The deflector clip 200 is attached using a tie band 530. However, another attachment means may be used including a part formed by the clip portion 205. The deflector clip 200 is attached to the electrical wires 505 so the injector wire extension 515 has sufficient length for the injector connector 520 to connect with the solenoid interface 105. The deflector clip 200 is attached to the electrical wires 505 so the compression brake wire extension 542 has sufficient length for the compression brake connector 540 to connect with the compression brake interface.

FIGS. 14–15 show the electrical connector plug 425, 525, which has a cylindrical shape. Other shapes may be used. The electrical connector plug 425, 525 has a sealing insert 905 and an outer cover 910. An O-ring 915 seals the connector plug 425,435 to the valve cover of the engine. Guide holes (not shown) are formed on the inside of electrical connector plug 425, 525. The guide holes are configured into a gridwork for receiving contact pins (not shown) attached to the end of each wire. The contact pins are inserted into the guide holes.

The sealing insert 905 forms an inverted shape, such as a cup, and is inserted into the outer cover 910. As seen in FIG. 15, a gasket 920 is attached to and forms to bottom of the sealing insert 905. When inserted, the gasket 920 seals the sealing insert 905 to the outer cover 910. Gasket 920 and O-ring 915 prevent hydraulic fluid from escaping through the electrical connector plug 425, 525.

The gasket 920 has pin holes 922 in like number and in similar gridwork matching the guide holes. The pin holes 922 align with the guide holes when the sealing insert 905 is inserted into the outer cover 910. For guide holes with contact pins, the contact pin heads 925 project through the pin holes 922. The gasket 920 seals the contact pin heads 925.

For guide holes without contact pins, the pin holes 922 remain open and will permit hydraulic fluid to leak through the electrical connector plug 425, 525. To avoid this situation, the wiring harness 402, 502 may use an electrical connector 425, 525 having the same number of guide and pin holes as contact pins. However, this "solution" creates manufacturing difficulties when different engines or a mixture of standard and compression brake engines are manufactured at the same facility.

To avoid problems such as having different electrical connector plugs on-hand and installing the wrong plug, a sealing plug pin 930 is preferred in the present invention. The sealing plug pin 930 is inserted into a guide hole when not in use. Any number of sealing plug pins may be used depending on the number of guide and pin holes without contact pins. On the sealing plug pin 930, a guide plug 932 seals the guide hole. A catch 934 helps position the sealing plug pin 930 properly in the outer cover 910. A plug pin head 936 projects through the associated pin hole 922. The gasket 920 seals the plug pin head 936. A base end 938 may include a detachable extension (not shown), which may be broken or otherwise removed once the sealing plug pin 930 is in the proper position.

FIGS. 17–20 shows the L-bracket 535 for guiding the compression brake wire extension 542 over a fuel injector. While an L-shaped bracket is shown, other shapes may be used depending on the configuration of the fuel injector. The L-bracket 535 has a channel 990 defined by a first side 940, a second side 945, and a bottom 950. The first side 940 extends at an angle to form a first angle portion 955. The second side 945 extends at an angle to form a second angle portion 960. The bottom 950 extends at an angle to form a bottom angle portion 965. The channel 990 accordingly extends at angle to form angle channel 995.

Preferably, the first side 940 forms a first slot 970. The second side 945 forms a second slot 975. The first angle portion 955 forms a third slot 980. The second angle potion forms a fourth slot 985. However, the L-bracket 535 may be made without the slots.

Upon assembly, the compression brake wire extension 542 is placed inside the channel 990 and angle channel 995 of the L-bracket 535. A tie band 530 is placed around the compression brake wire extension 542 and the L-bracket 535, the tie band 530 disposed in the slots 970, 975. Another tie band 530 is placed around the compression brake wire extension 342 and the L-bracket 535. The other tie band 530 is disposed in the slots 980, 985.

While the invention has been described and illustrated, this description is by way of example only. Additional advantages will occur readily to those skilled in the art, who may make changes without departing from the true spirit and scope of the invention. Therefore, the invention is not limited to the specific details, representative devices, and illustrated examples in this description. Accordingly, the scope of the invention is to be limited only as necessitated by the accompanying claims.

What is claimed is:

1. A deflector clip for a fuel injector, the deflector clip comprising:

a clip portion having, a clip body, a fixed arm coupled to the clip body, an adjustable arm operatively coupled to the clip body, and wherein the clip body and arms define a slot configured for mounting the deflector clip on the fuel injector; and a deflector portion attached to the clip portion.

2. A deflector clip according to claim 1, wherein the clip portion further comprises:

a back brace integrally joined to the clip body;

a top support coupled to the back brace, the top support essentially parallel and axially connected to the fixed arm; and a bottom support coupled to the back brace, the bottom support essentially parallel to the adjustable arm.

3. A deflector clip according to claim 2, wherein:

the top support is essentially parallel to the bottom support; and the back brace is essentially perpendicular to the top and bottom supports.

4. A deflector clip according to claim 2, wherein at least one of the top and bottom supports is tapered.

5. A deflector clip according to claim 2, wherein at least one of the top and bottom supports has at least one wedge portion disposed to point toward the other support.

6. A deflector clip according to claim 1, wherein:

when the adjustable arm is not flexed, the distance between the fixed arm and the adjustable arm is the same as or less than a minimum tolerance for the fuel injector; and when the adjustable arm is fully flexed, the distance between the fixed arm and the adjustable arm is greater than a maximum tolerance for the fuel injector.

7. A deflector clip according to claim 1, wherein:

the clip portion has a bottom support essentially parallel to the adjustable arm;

the bottom support and the adjustable arm separate to form an adjustment aperture; and the deflector portion attaches to the bottom support.

8. A deflector clip according to claim 1, further comprising a bridge element for attaching the clip portion to the deflector portion.

9. A deflector clip according to claim 8, further comprising at least one gusset attached to the bridge element.

10. A deflector clip according to claim 1, wherein the deflector forms a deflector cavity defined by a flat side, a tapered side, a top, and a nose piece, wherein the top is connected to the clip body.

11. A deflector clip according to claim 1, wherein the deflector is disposed adjacent to a drain when the deflector clip is mounted on the fuel injector.

12. A deflector clip assembly for a fuel injection system, the deflector clip assembly comprising:

at least one deflector clip having, a clip portion having, a clip body, a fixed arm coupled to the clip body, an adjustable arm operatively coupled to the clip body, and wherein the clip body and arms define a slot configured for mounting the deflector clip on a fuel injector; and a deflector portion attached to the clip portion a wiring harness for providing electrical pulses to at least one fuel injector in the fuel injection system; and a connecting means for connecting the wiring harness to the at least one deflector clip.

13. A deflector clip assembly according to claim 12, wherein the connecting means is a tie band.

14. A deflector clip assembly according to claim 13, wherein the clip portion has at least one post connected to the clip body, and the tie band engages the at least one post.

15. A deflector clip assembly according to claim 12, wherein the wiring harness comprises:

an electrical connector plug;

at least one wire having an injector wire extension, the at least one wire operatively connected to the electrical connector plug; and an injector connector operatively connected to the injector wire extension.

16. A deflector clip assembly according to claim 15, wherein the electrical connector plug has at least one sealing plug pin disposed within at least one contact pin hole.

17. A deflector clip assembly according to claim 12, wherein the wiring harness is a compression brake wiring harness.

18. A deflector clip assembly according to claim 15, wherein the wiring harness further comprises:

an electrical connector plug;

at least one injecting wire operatively connected to the electrical connector plug, the at least one injecting wire having an injector wire extension;

an injector connector operatively connected to the injector wire extension;

at least one braking wire operatively connected to the electrical connector plug, the at least one braking wire having a compression brake wire extension; and a compression brake connector operatively connected to the compression brake wire extension.

19. A deflector clip assembly according to claim 18, wherein the wiring harness further comprises a bracket attached to the compression brake wire extension.

20. A deflector clip according to claim 12, wherein:

when the adjustable arm is not flexed, the distance between the fixed arm and the adjustable arm is the same as or less than a minimum tolerance for the fuel injector; and when the adjustable arm is fully flexed, the distance between the fixed arm and the adjustable arm is greater than a maximum tolerance for the fuel injector.

21. A diesel engine having a fuel injection system with a deflector clip assembly, the diesel engine comprising:

at least one fuel injector;

at least one deflector clip mounted on the at least one fuel injector, the at least
one deflector clip including,
a clip portion having,
a clip body,
fixed arm coupled to the clip body,
an adjustable arm operatively coupled to the clip body, and
wherein the clip body and arms define a slot configured for mounting the deflector clip on the at least one fuel injector, and
a deflector portion attached to the clip portion, the deflector portion disposed adjacent to a drain on the at least one fuel injector;

a wiring harness for providing electrical pulses to the at least one fuel injector,
the wiring harness having,
an electrical connector plug,
at least one wire having an injector wire extension, the at least one wire operatively connected to the electrical connector plug, and
an injector connector operatively connected to the injector wire extension; and a connecting means for connecting the wiring harness to the at least one deflector clip.

22. A diesel engine according to claim 21, wherein:

the distance between the fixed arm and the adjustable arm, when the adjustable arm is not flexed, is the same as or less than a minimum tolerance for the fuel injector; and the distance between the fixed arm and the adjustable arm, when the adjustable arm is fully flexed, is greater than a maximum tolerance for the fuel injector.

23. A diesel engine according to claim 21, wherein the wiring harness is a compression brake wiring harness.

24. A diesel engine according to claim 21, wherein the deflector is configured to deflect hydraulic fluid from the drain to a designated area in the diesel engine.

25. A diesel engine according to claim 21, wherein:

the clip portion has a bottom support essentially parallel to the adjustable arm;

the bottom support and the adjustable arm separate to form an adjustment aperture; and the deflector portion attaches to the bottom support.

* * * * *